US011034005B2

(12) United States Patent
Suarez

(10) Patent No.: US 11,034,005 B2
(45) Date of Patent: Jun. 15, 2021

(54) DRY-FIRE LOCKOUT MECHANSIM FOR A POWERED FASTENER DRIVER

(71) Applicant: TTI (MACAO COMMERCIAL OFFSHORE) LIMITED, Macau (MO)

(72) Inventor: Joseph M. Suarez, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 152 days.

(21) Appl. No.: 16/051,658

(22) Filed: Aug. 1, 2018

(65) Prior Publication Data

US 2019/0039219 A1 Feb. 7, 2019

Related U.S. Application Data

(60) Provisional application No. 62/540,709, filed on Aug. 3, 2017.

(51) Int. Cl.

| | |
|---|---|
| ***B25C 1/00*** | (2006.01) |
| ***B25C 5/16*** | (2006.01) |
| *B25C 5/06* | (2006.01) |

(52) U.S. Cl.

CPC ..... *B25C 1/008* (2013.01); *B25C 1/005* (2013.01); *B25C 5/1606* (2013.01); *B25C 5/06* (2013.01)

(58) Field of Classification Search

CPC ..... B25C 5/1606; B25C 1/005; B25C 1/008

USPC ..... 227/8

See application file for complete search history.

(56) References Cited

U.S. PATENT DOCUMENTS

| | | | | |
|---|---|---|---|---|
| 3,320,860 | A | 5/1967 | Bade | |
| 3,323,602 | A | 6/1967 | Lysell | |
| 5,732,870 | A | 3/1998 | Moorman et al. | |
| 5,918,788 | A | 7/1999 | Moorman et al. | |
| 6,382,492 | B1 | 5/2002 | Moorman et al. | |
| 6,431,425 | B1 | 8/2002 | Moorman et al. | |
| 6,966,477 | B1 * | 11/2005 | Chien-Kuo | B25C 1/005 227/120 |
| 7,163,134 | B2 | 1/2007 | Moeller et al. | |
| 7,201,301 | B2 | 4/2007 | Moeller et al. | |
| 7,341,171 | B2 | 3/2008 | Moeller et al. | |
| 7,383,974 | B2 | 6/2008 | Moeller et al. | |
| 7,431,185 | B2 | 10/2008 | Moeller et al. | |
| 7,487,898 | B2 | 2/2009 | Moeller et al. | |
| 7,497,271 | B2 | 3/2009 | Moeller et al. | |

(Continued)

OTHER PUBLICATIONS

Australian Patent Office Action for Application No. 2018211309 dated Mar. 5, 2019, 2 pages.

*Primary Examiner* — Anna K Kinsaul
*Assistant Examiner* — Chinyere J Rushing-Tucker
(74) *Attorney, Agent, or Firm* — Michael Best & Friedrich LLP

(57) ABSTRACT

A powered fastener driver includes a magazine configured to receive fasteners, a pusher slidably coupled to the magazine, a nosepiece coupled to the magazine, and a workpiece contact element movable with respect to the nosepiece. The powered fastener driver further includes a lockout member pivotally coupled to the nosepiece, and a magnet exerting a magnetic force on the lockout member to bias the lockout member toward a first position. The pusher moves the lockout member to a second position where the lockout member blocks movement of the workpiece contact element when a predetermined number of fasteners remain in the magazine.

19 Claims, 11 Drawing Sheets

(56) References Cited

U.S. PATENT DOCUMENTS

| | | | | |
|---|---|---|---|---|
| 7,506,788 | B2 | 3/2009 | Liang et al. | |
| 7,510,105 | B2 | 3/2009 | Moeller et al. | |
| 7,673,779 | B2 | 3/2010 | Moeller et al. | |
| 8,191,751 | B2 | 6/2012 | Moeller et al. | |
| 2010/0170929 | A1 | 7/2010 | Chang | |
| 2012/0085806 | A1* | 4/2012 | Lee | B25C 1/008 227/8 |
| 2012/0187175 | A1* | 7/2012 | Wu | B25C 1/047 227/8 |
| 2013/0320060 | A1* | 12/2013 | Gregory | B25C 1/008 227/8 |
| 2014/0069981 | A1* | 3/2014 | Ricordi | B25C 1/008 227/8 |
| 2015/0306751 | A1 | 10/2015 | Bralla et al. | |

* cited by examiner

DRY-FIRE LOCKOUT MECHANSIM FOR A POWERED FASTENER DRIVER

CROSS REFERENCE TO RELATED APPLICATIONS

This application claims priority to U.S. Provisional Patent Application No. 62/540,709 filed on Aug. 3, 2017, the entire content of which is incorporated by reference herein.

FIELD OF THE INVENTION

The present invention relates to powered fastener drivers, and more specifically to a dry-fire lockout mechanism for a powered fastener driver.

BACKGROUND OF THE INVENTION

Powered fastener drivers are typically used to drive fasteners (e.g., nails, staples, tacks, etc.) into a workpiece. These powered fastener drivers operate utilizing a relatively large driving force from various means known in the art (e.g. compressed air generated by an air compressor, electrical energy, etc.) to drive the fasteners into the workpiece. These designs may include dry-fire lockouts to prevent the powered fastener driver from actuating when no fasteners remain.

SUMMARY OF THE INVENTION

The present invention provides, in one aspect, a powered fastener driver including a magazine configured to receive fasteners, a pusher slidably coupled to the magazine, a nosepiece coupled to the magazine, and a workpiece contact element movable with respect to the nosepiece. The powered fastener driver further includes a lockout member pivotally coupled to the nosepiece, and a magnet exerting a magnetic force on the lockout member to bias the lockout member toward a first position. The pusher moves the lockout member to a second position where the lockout member blocks movement of the workpiece contact element when a predetermined number of fasteners remain in the magazine.

The present invention provides, in another aspect, a powered fastener driver including a magazine configured to receive fasteners and a pusher slidably coupled to the magazine. The pusher includes a pin. The powered fastener driver further includes a nosepiece coupled to the magazine, a workpiece contact element movable with respect to the nosepiece, and a lockout member pivotally coupled to the nosepiece. The lockout member includes a first end engageable with the pin, a second end opposite the first end, and at least a portion formed of a ferromagnetic material. The powered fastener driver further includes a cover coupled to the nosepiece, the cover defining a magnet holder, and a magnet coupled to the cover by the magnet holder. The magnet exerts a magnetic force on the lockout member to bias the lockout member toward a first position, and the pin engages the first end of the lockout member when a predetermined number of fasteners remain in the magazine. The pin rotates the lockout member to a second position where the second end of the lockout member blocks movement of the workpiece contact element when the predetermined number of fasteners remain in the magazine.

Other features and aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
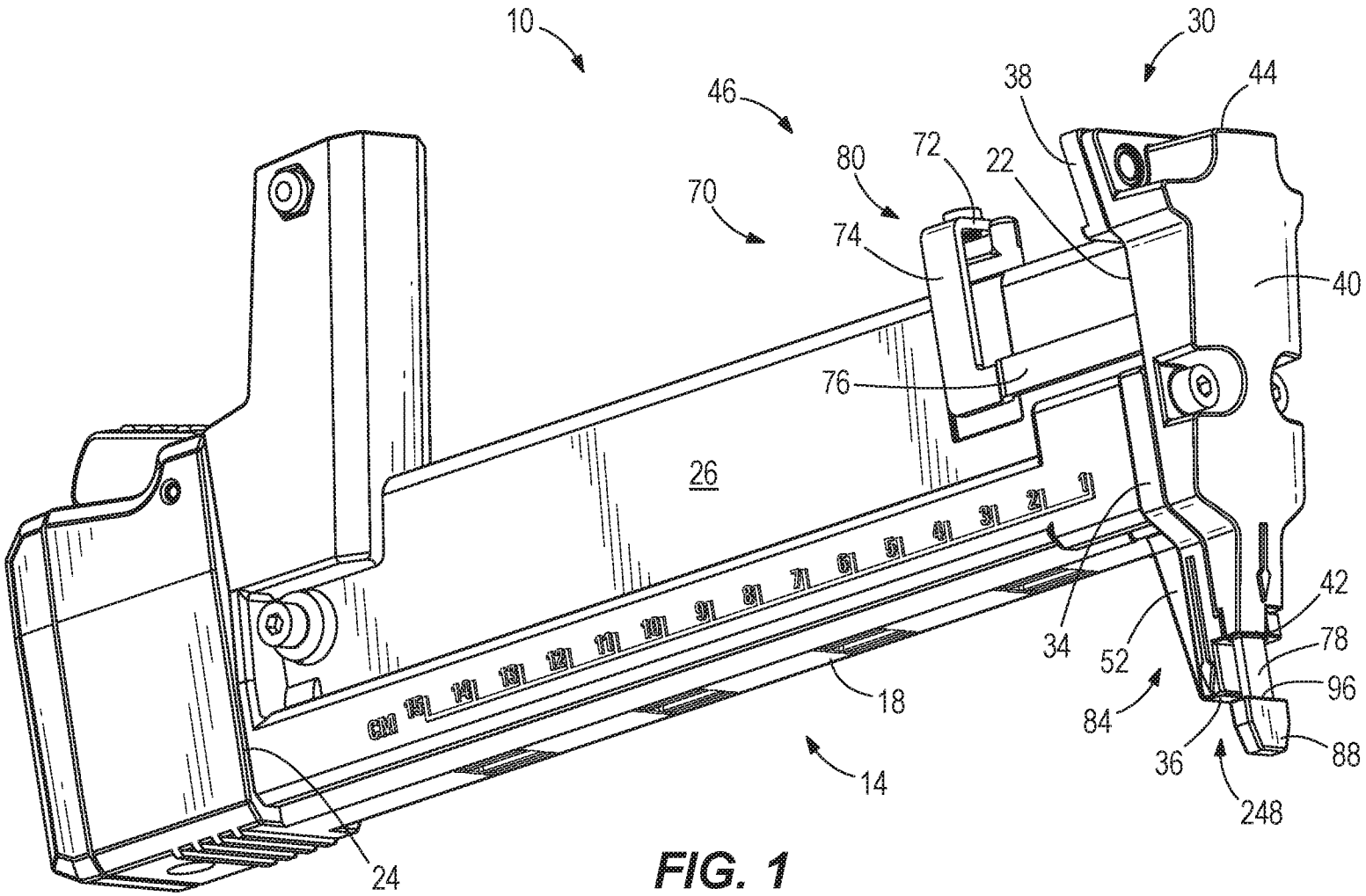
FIG. 1 is a perspective view of a portion of a powered fastener driver including a nosepiece assembly for driving fasteners.

With reference to FIG. 1, a powered fastener driver is operable to drive fasteners (e.g., nails, staples, tacks, etc.) held within a magazine assembly 10 into a workpiece. In other words, the magazine assembly 10 includes a magazine 14 having a magazine body 18 configured to receive the fasteners to be driven into the workpiece by the powered fastener driver. The fastener driver generally includes a body, a handle coupled to the body, and a trigger (not shown) for operating the fastener driver. The body of the powered fastener driver may further include other elements for operating the powered fastener driver (i.e. air compressor, electronics, springs etc.). The magazine body 18 has a first end 22 and a second end 24 opposite the first end 22. The magazine body 18 further includes a first side 26 and a second side 28 (FIG. 5) opposite the first side 26.

A nosepiece assembly 30 is positioned at the first end 22 of the magazine body 18. The nosepiece assembly 30 generally includes a front plate 34 coupled to the first end 22 of the magazine body 18, a cover 40 coupled to the front plate 34, and a workpiece contact element 46 movable with respect to the front plate 34. The front plate 34 is oriented substantially perpendicular to the magazine body 18. Furthermore, the front plate 34 includes a first, lower flange 36 and a second, upper flange 38 opposite the first flange 36.

With continued reference to FIG. 1, the cover 40 substantially covers the front plate 34. In the illustrated embodiment, the cover 40 extends from the first flange 36 to the second flange 38 of the front plate 34. The cover 40 includes a first end 42 and a second end 44 corresponding to the first flange 36 and the second flange 38 of the front plate 34. The cover 40 may be coupled to the front plate 34 using a fastener (not shown) such as a bolt, screw, etc. Furthermore, the cover 40 is generally tapered from the second end 44 to the first end 42.

Figure 5:
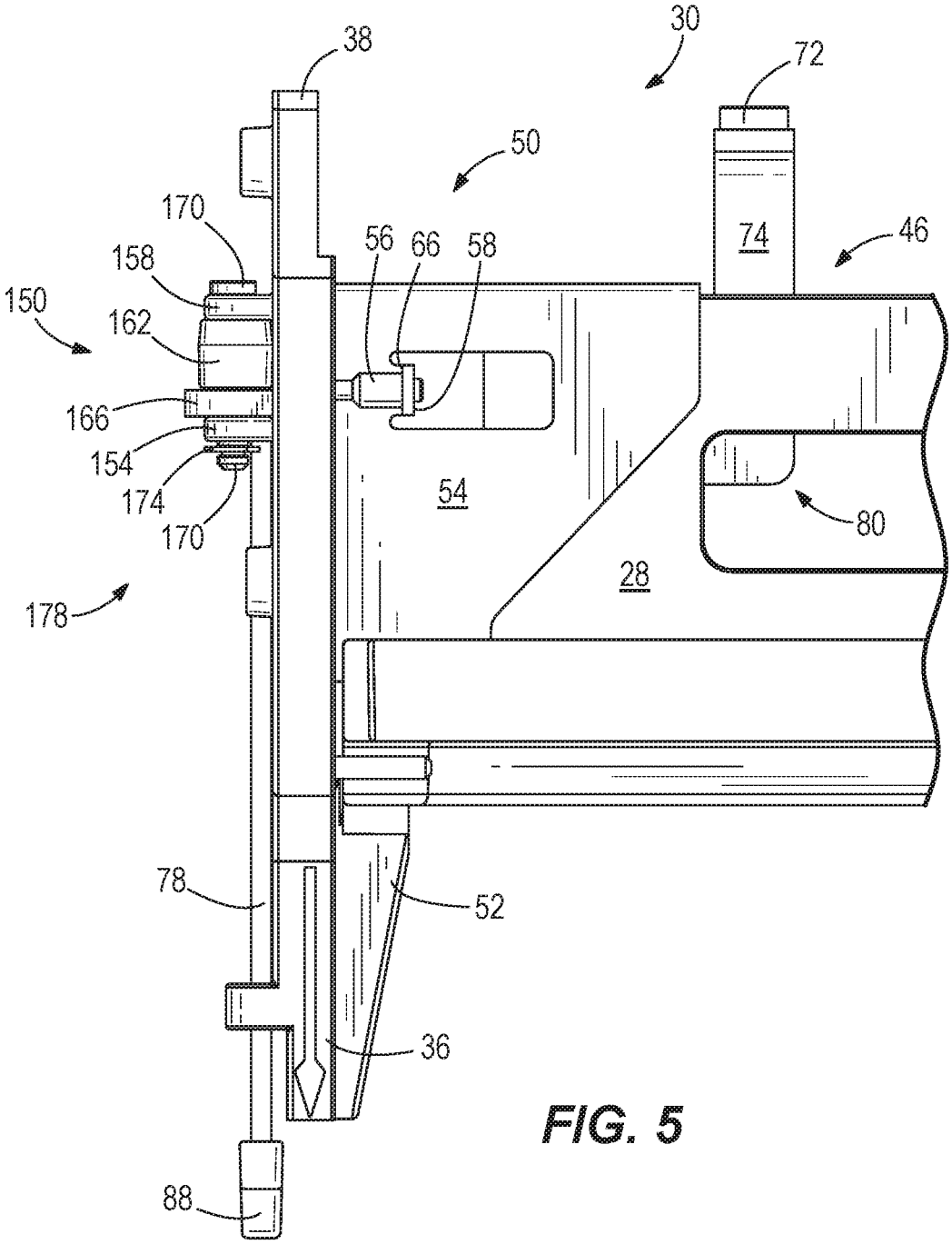
FIG. 5 is another side view of the nosepiece assembly of FIG. 2 illustrating a pin coupled to a fastener pusher system.
Figure 10:
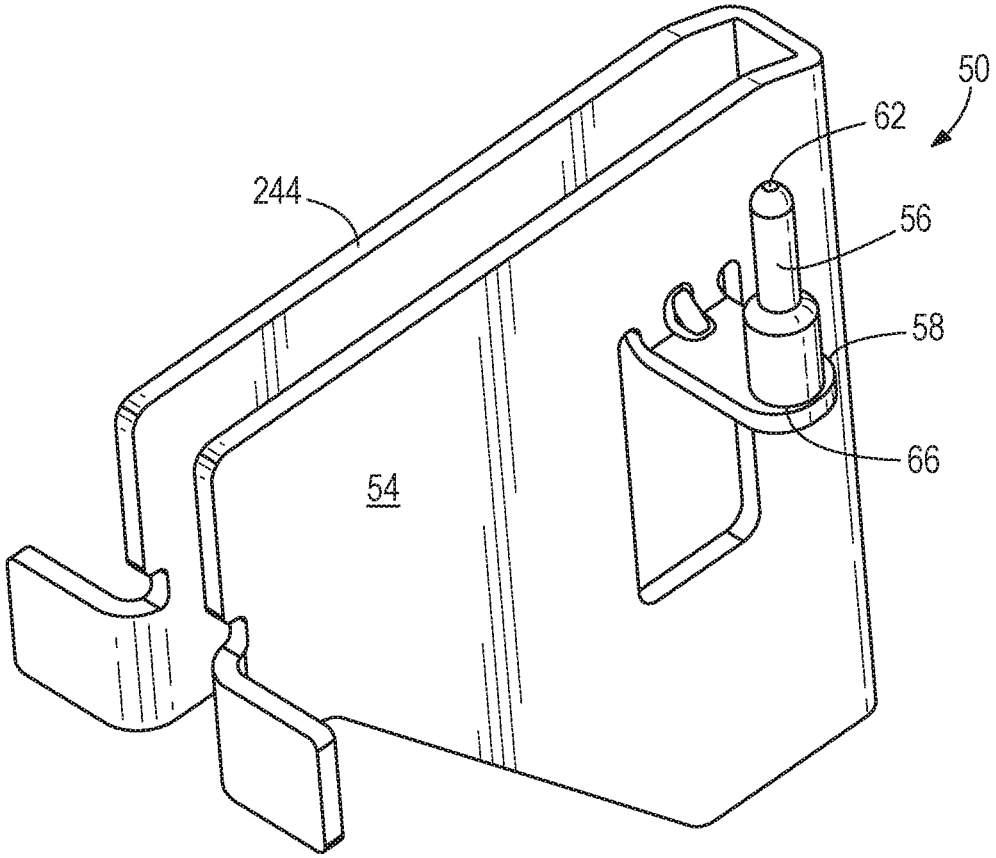
FIG. 10 is a perspective view of the pusher of FIG. 6.

With reference to FIGS. 2-6, the magazine assembly 10 further includes a pusher 50 (FIG. 5) and a lower guide 52 positioned within the magazine body 18. The illustrated pusher 50 and the lower guide 52 are positioned at the first end 22 of the body 18. The lower guide 52 of the magazine 14 is positioned adjacent the first flange 36 of the front plate 34. With reference to FIG. 10, the illustrated pusher 50 includes a pusher bracket 54 and a pin 56 coupled to a side of the pusher bracket 54 (i.e. the side opposite the side of the fastener driver 10 having the workpiece contact element 46). In other embodiments, the pin 56 may be coupled to the same side as the workpiece contact element 46. Furthermore, the pusher bracket 54 is positioned near the upper flange 38 of the front plate 34 (FIG. 5).

With reference to FIG. 10, the pin 56 includes a first end 62 and a second end 66. The illustrated pin 56 is coupled to the side of the pusher bracket 54 by a support 58. More specifically, the second end 66 of the pin 56 is coupled to the support 58 (FIG. 5). The pusher 50 is slidably coupled to the magazine body 18 and biases any fasteners contained within the magazine 14 toward the front plate 34 of the nosepiece assembly 30.

Figure 2:
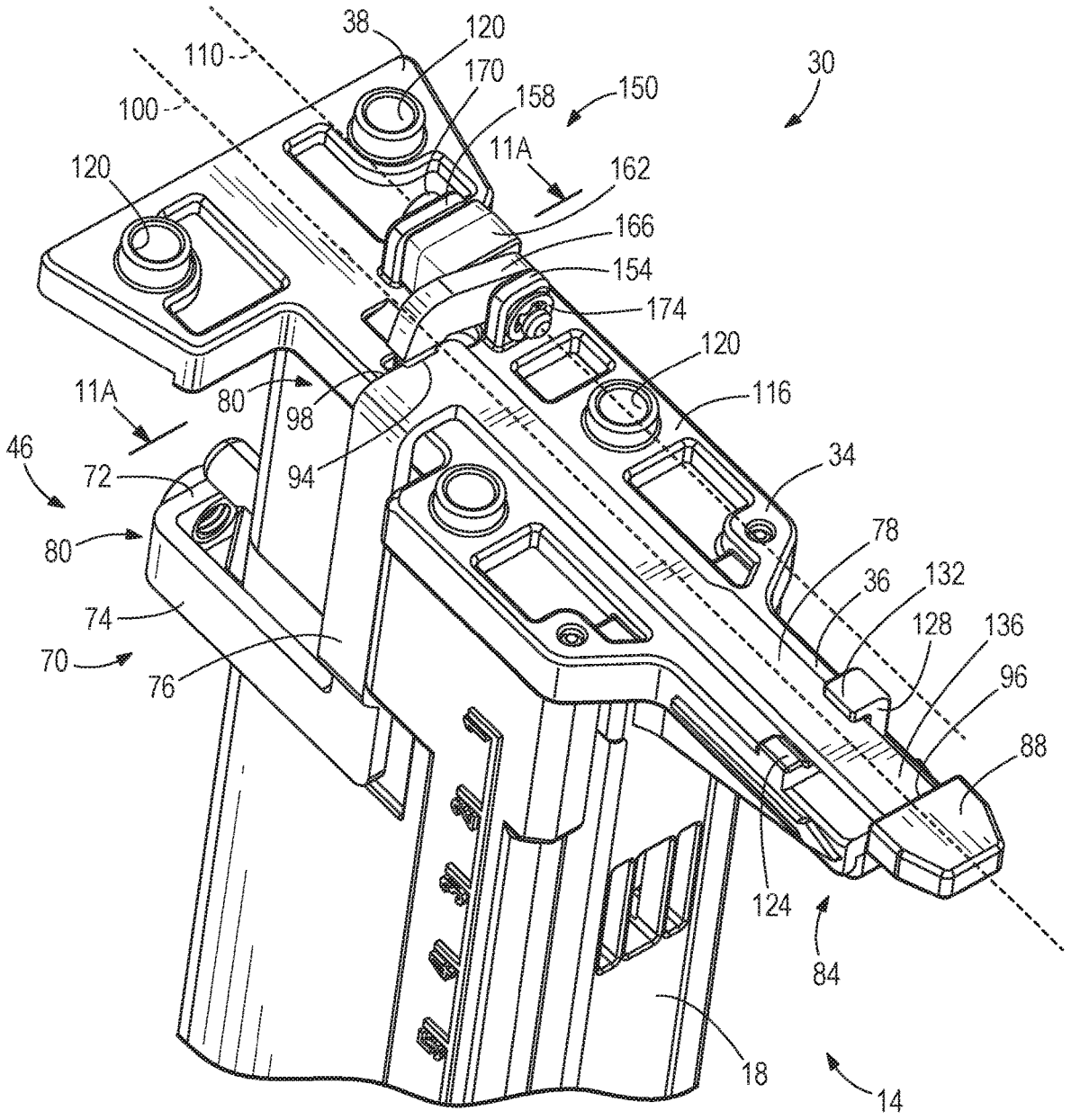
FIG. 2 is a partial perspective view of the nosepiece assembly of FIG. 1 illustrating a dry-fire lockout mechanism.
Figure 3:
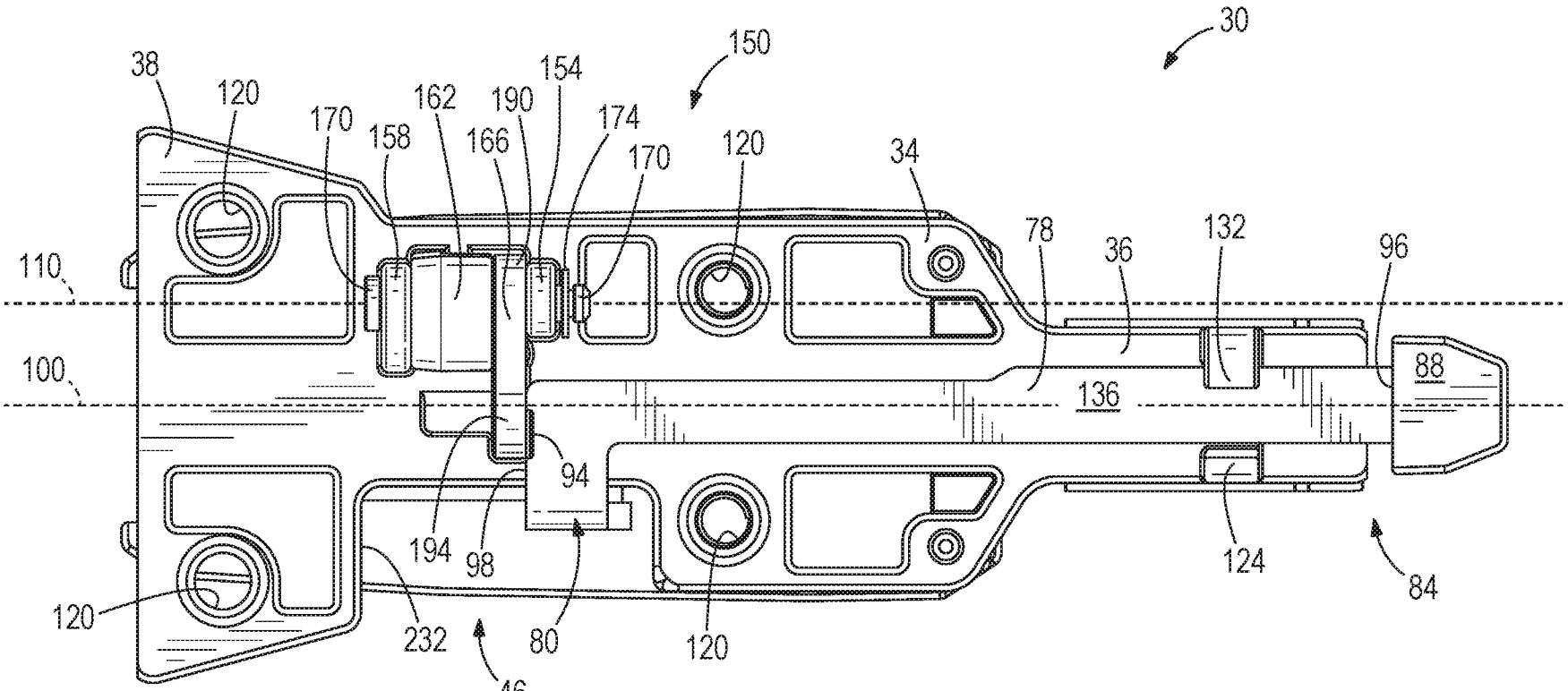
FIG. 3 is a front view of the nosepiece assembly of FIG. 2.
Figure 4:
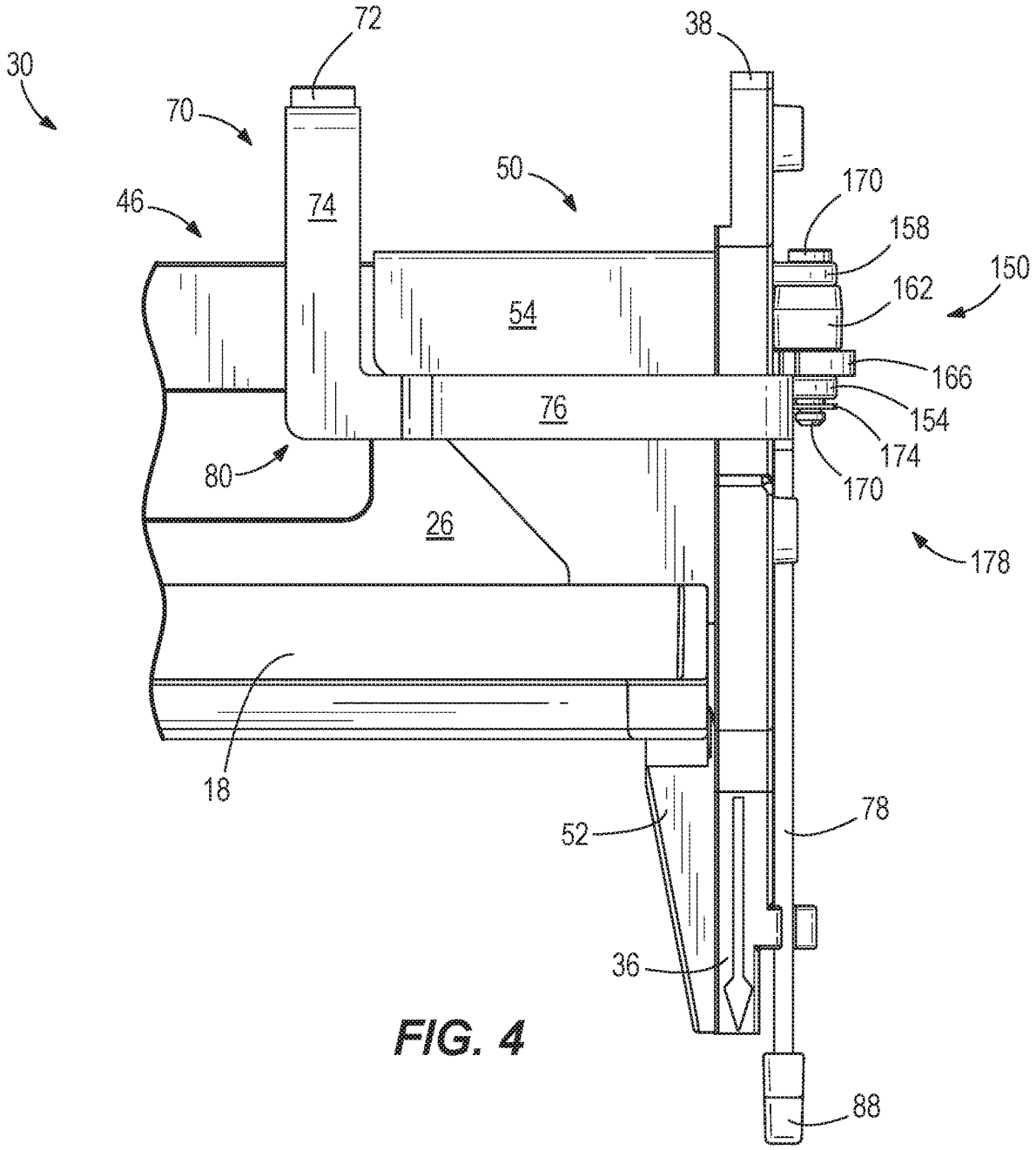
FIG. 4 is a side view of the nosepiece assembly of FIG. 2 illustrating a workpiece contact element.

With reference to FIGS. 2-6, the workpiece contact element 46 of the nosepiece assembly 30 extends from the lower flange 36 to the upper flange 38 of the front plate 34 (FIGS. 2-3) and includes a plurality of interconnected segments 70. The illustrated workpiece contact element 46 includes generally four segments 70 in which adjacent segments are coupled by a bend 80. In particular, a first segment 72 of the workpiece contact element 46 is positioned below the second flange 38 of the front plate 34. A second segment 74 is coupled to the first segment 72 by one of the bends 80. The second segment 74 extends perpendicular to the first segment 72. Similarly, one of the bends 80 couples the second segment 74 to a third segment 76. The second and third segments 74, 76 are positioned near the first side 26 of the magazine body 18. In addition, the second and third segments 74, 76 are perpendicular to each other (FIGS. 2-3). Likewise, the third segment 76 is coupled to a fourth segment 78 by one of the bends 80. The fourth segment 78 is perpendicular to the third segment 76. The fourth segment 78 is at least partially enclosed by the cover 40. Furthermore, the fourth segment 78 has a tip 84 that extends through the first end 42 of the cover (FIG. 1). In the illustrated embodiment, the fourth segment 78 is positioned between the first flange 36 of the front plate 34 and the first end 42 of the cover 40 of the nosepiece assembly 30 (FIG. 1). The fourth segment 78 of the workpiece contact element 46 further includes a cap 88 (i.e., a no-mar pad) enclosing the tip 84 of the fourth segment 78 (FIGS. 2-3). The tip 84 including the cap 88 of the fourth segment 78 is configured to engage a surface of the workpiece.

With continued reference to FIGS. 2-6, the fourth segment 78 of the workpiece contact element 46 includes a first edge 96 having the tip 84 and a second, opposite edge 98 (FIG. 3). The fourth segment 78 of the workpiece contact element 46 defines a longitudinal axis 100. Specifically, the longitudinal axis 100 extends from the first edge 96 to the second edge 98 of the fourth segment 78 (FIGS. 2-3). Furthermore, the second edge 98 defines a recess 94 (FIGS. 2-3), as discussed in greater below. The workpiece contact element 46 is moveable with respect to the front plate 34 along the first axis 100. In other words, the workpiece contact element 46 may translate with respect to the front plate 34 along the first axis 100 when the tip 84 is depressed against the workpiece.

Figure 6:
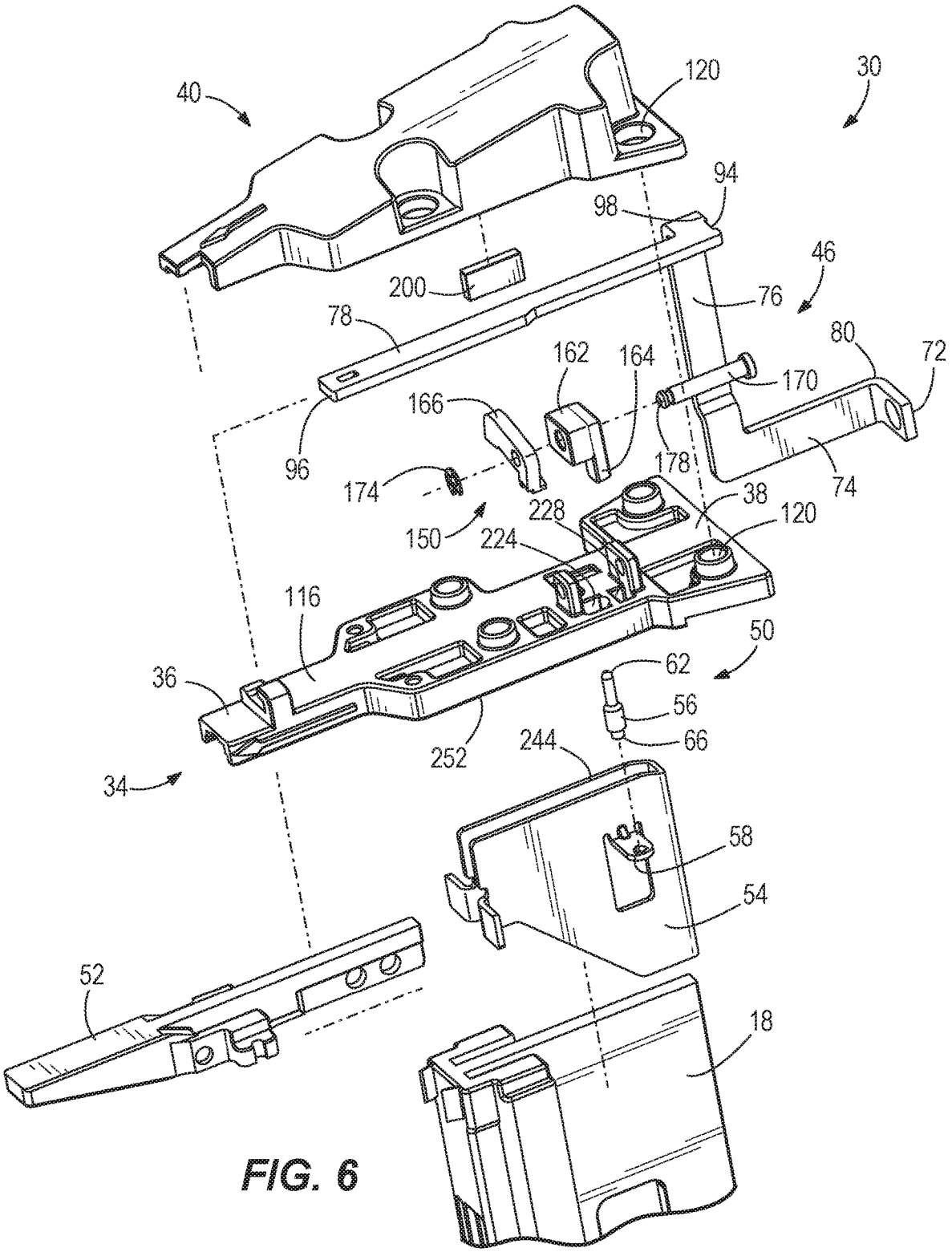
FIG. 6 is an exploded view of the nosepiece assembly of FIG. 1 including a cover, a front plate, a lockout member of the dry-fire lockout mechanism, and a pusher.

With continued reference to FIGS. 2-6, an inner surface 116 of the front plate 34 of the nosepiece assembly 30 defines cylindrical apertures 120. The illustrated front plate 34 includes two apertures 120 positioned on the second flange 38 of the front plate 34 and two apertures 120 positioned between the first flange 36 and the second flange 38 of the front plate 34 (FIG. 3). In other embodiments, the front plate 34 may define at least one or more apertures 120. The cover 40 defines apertures 120 corresponding to the apertures 120 defined by the front plate 34 (FIG. 6). The cylindrical apertures 120 are configured to receive fasteners. The fasteners are configured to secure the cover 40 to the front plate 34 of the nosepiece assembly 30. In other embodiments, the cover 40 may be coupled to the front plate 34 at any desired location between the first flange 36 and the second flange 38 of the front plate 34 and may use any number of fasteners to secure the cover 40 to the front plate 34.

With continued reference to FIGS. 2-6, the inner surface 116 of the front plate 34 of the nosepiece assembly 30 further includes first and second extensions 124, 128 positioned near the tip 84 of the workpiece contact element 46 (FIGS. 2-3). In particular, the first and second extensions 124, 128 are positioned on opposite sides of the fourth segment 78 of the workpiece contact element 46. Furthermore, the illustrated second extension 128 has a guide projection 132 extending over a top 136 of the fourth segment 78 of the workpiece contact element 46. The first and second extensions 124, 128 and the guide projection 132 are configured to guide the fourth segment 78 as the workpiece contact element 46 translates along the first axis 100.

With continued reference to FIGS. 2-6, the powered fastener driver further includes a dry-fire lockout assembly 150. The dry-fire lockout assembly 150 includes a first mounting flange 154, a second mounting flange 158, a base 162, a lockout member 166 pivotally coupled to the first and second flanges 154, 158 by an axle 170, and a magnet 200 (FIG. 6) positioned near the lockout member 166. The first and second mounting flanges 154, 158 extend from the inner surface 116 of the front plate 34 (FIG. 2). The axle 170 defines a second, pivot axis 110 that extends through the first and second mounting flanges 154, 158 and the lockout member 166. The first and second axes 100, 110 are substantially parallel (FIGS. 2-3). The dry-fire lockout assembly further includes a clip 174 coupled to an end 178 (FIG. 6) of the axle 170 to secure the axle to the mounting flanges 154, 158. The base 162 is positioned adjacent the lockout member 166 and coupled to the axle 170. The base 162 has a protrusion 164 extending from the base 162 (FIG. 6), as further discussed below. The base 162 may be an elastic support for the lockout member 166. Specifically, the base 162 may be configured to help absorb impact on the lockout member 166 from the workpiece contact element 46 in order to minimize the risk of bending of the lockout member 166.

Figure 8:
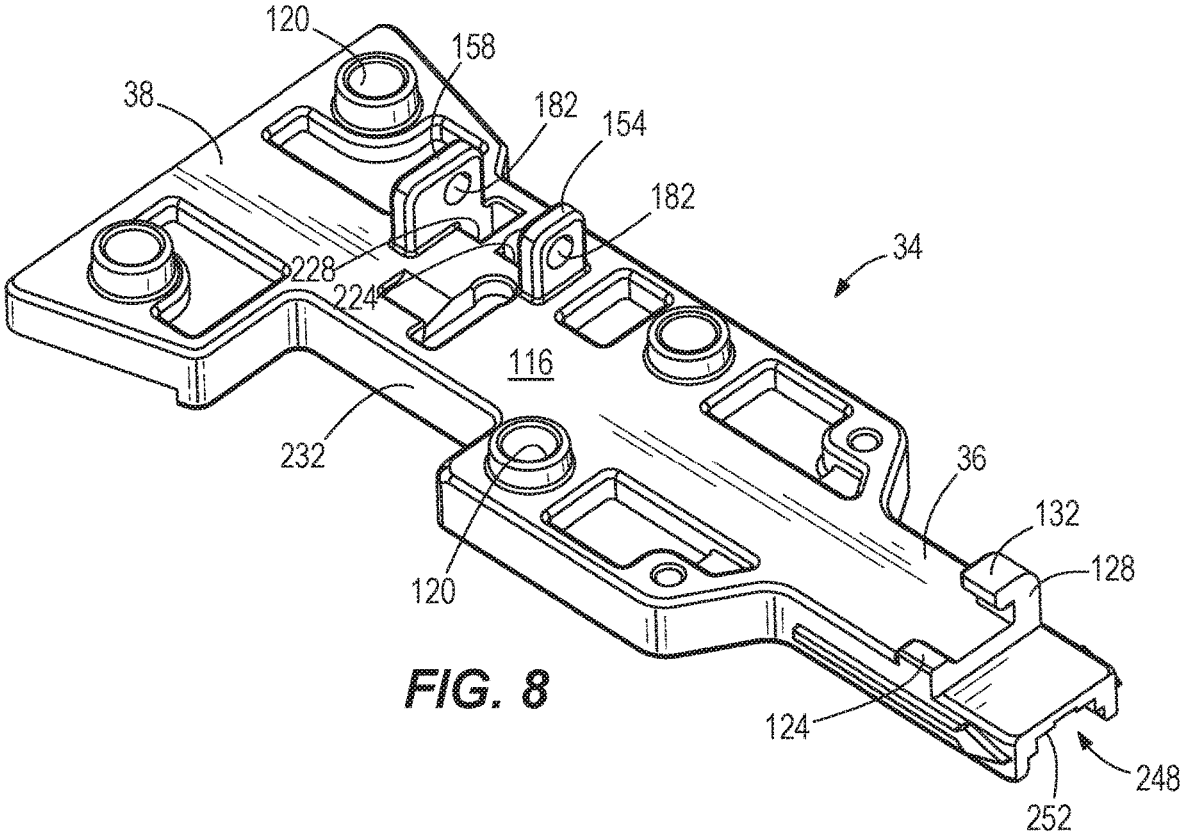
FIG. 8 is a perspective view of the front plate of FIG. 6.

With reference to FIGS. 2-6, the first and second mounting flanges 154, 158 include apertures 182 configured to receive the axle 170 (FIG. 8). The first and second mounting flanges 154, 158 are configured to hold the axle 170 above the inner surface 116 of the front plate 34. As such, the axle 170 is configured to allow pivoting of the lockout member 166 held above the inner surface 116. In other words, the lockout member 166 is pivotally coupled to the front plate 34 by the axle 170 received between the first and second mounting flanges 154, 158.

Figure 9:
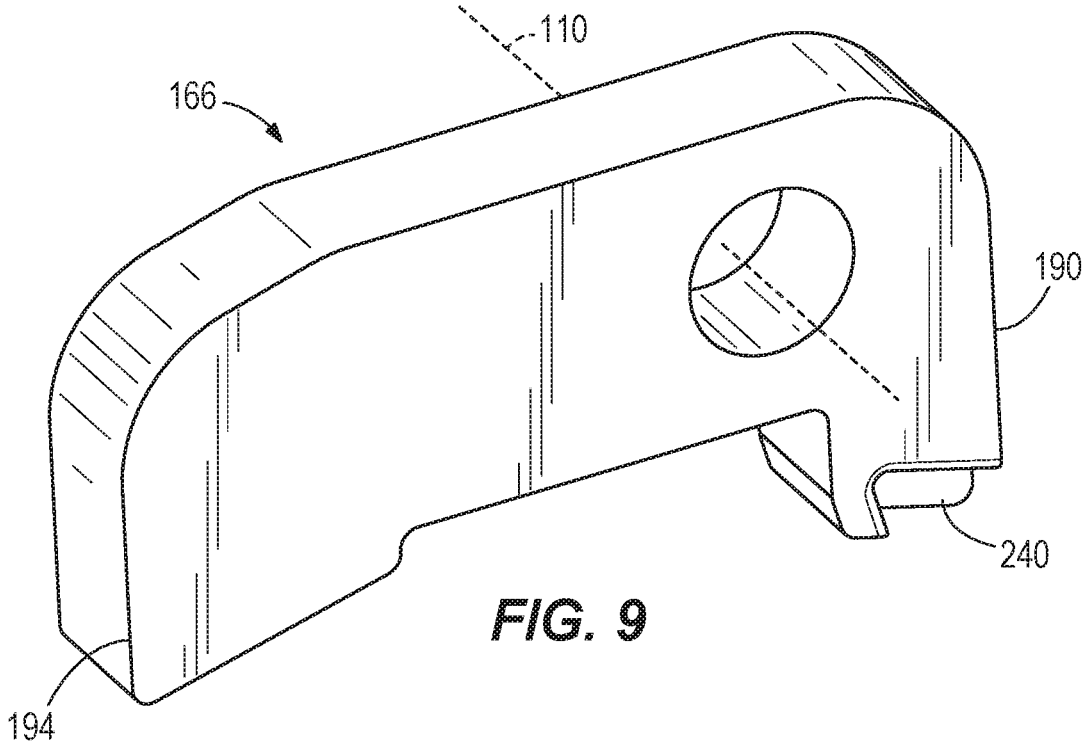
FIG. 9 is a perspective view of the lockout member of FIG. 6.
Figure 9A:
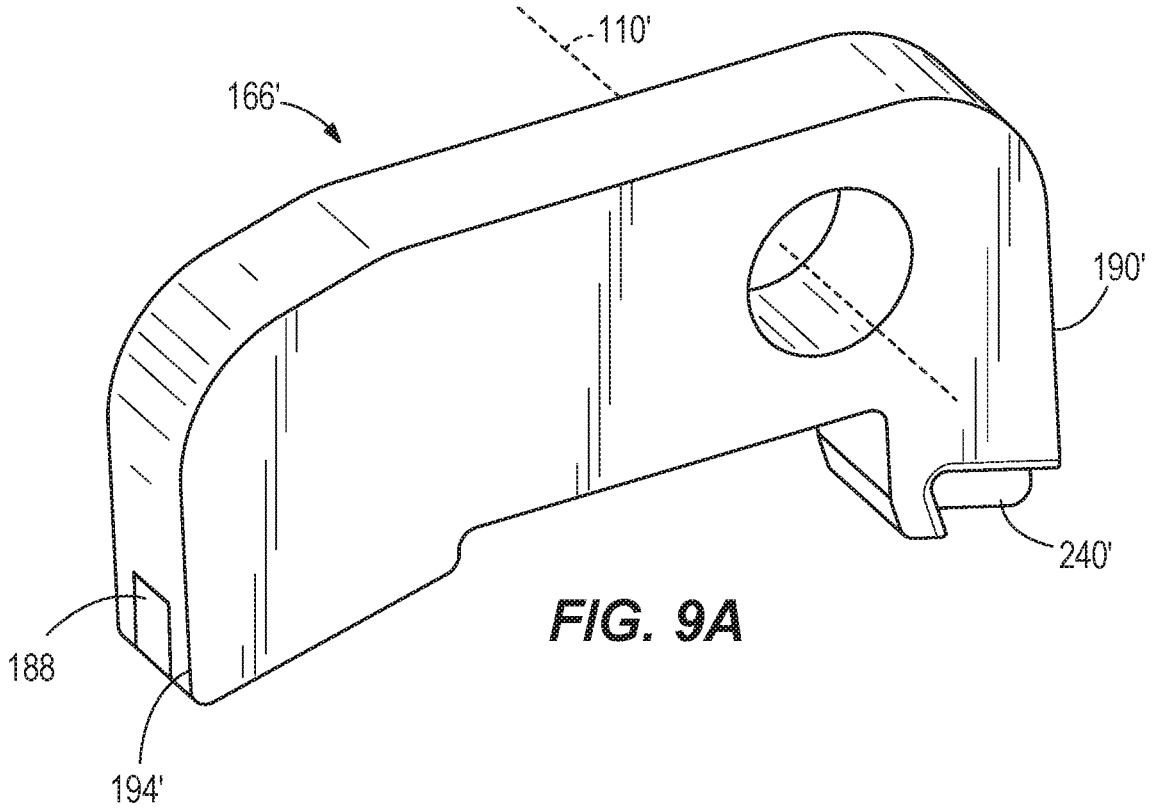
FIG. 9A is a perspective view of another lockout member including an insert formed of ferromagnetic material.

With reference to FIGS. 9 and 9A, the lockout member 166 includes a first end 190 coupled for pivoting about the axle 170 and a second end 194 opposite the first end 190 (FIG. 3). As described above, the first end 190 of the lockout member 166 pivots about the second, pivot axis 110. Moreover, the lockout member 166 is oriented from the first end 190 to the second end 194 substantially perpendicular to the first and second axes 100, 110 (FIG. 3). Therefore, the lockout member 166 is substantially perpendicular to the fourth segment 78 of the workpiece contact element 46 defining the first axis 100, as further discussed below. The lockout member 166 includes at least a portion formed of a ferromagnetic material. In an alternative embodiment, as shown in FIG. 9A, the lockout member 166' may further include an insert 188 formed of a ferromagnetic material.

Figure 7:
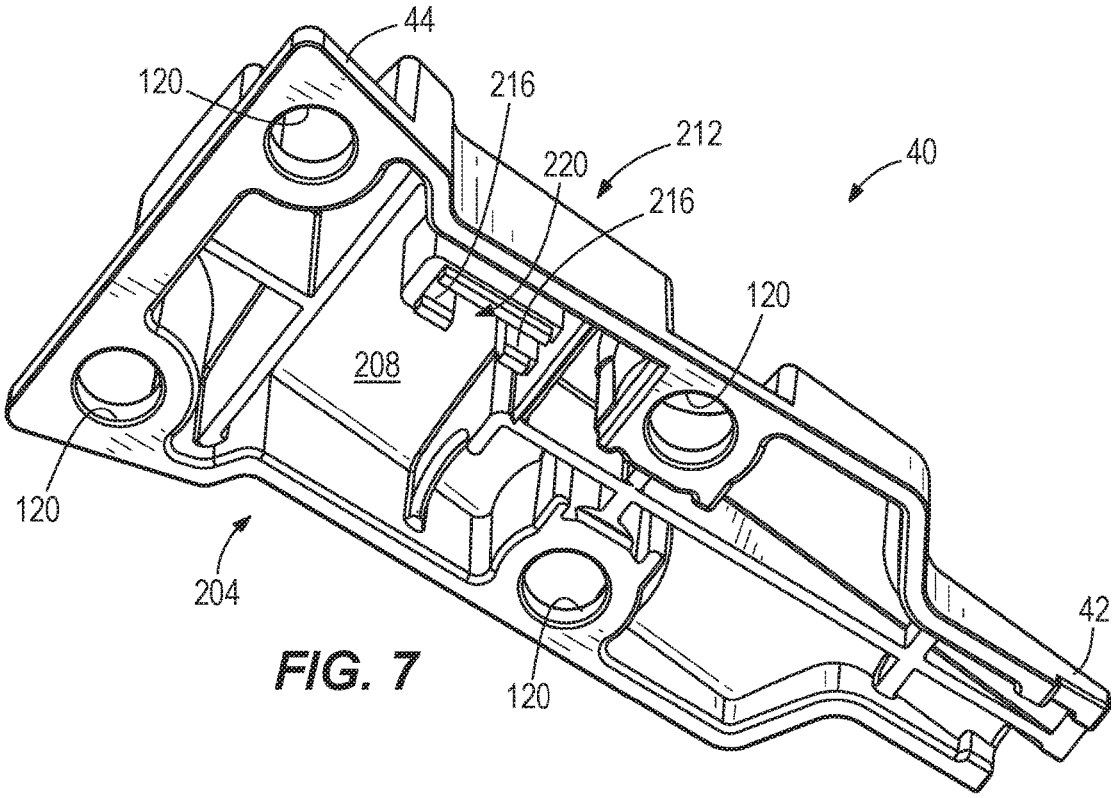
FIG. 7 is a perspective view of the cover of FIG. 6.

With reference to FIG. 7, the cover 40 partially defines a cavity 204 when the cover 40 is coupled to the front plate 34. The dry-fire lockout mechanism 150 may extend from the inner surface 116 of the front plate 34 into the cavity 204 defined by the cover 40. Furthermore, the cover 40 defines a magnet holder 212 extending from an inner surface 208 of the cover 40 into the cavity 204.

With reference to FIGS. 6 and 7, the dry-fire lockout mechanism 150 further includes the magnet 200 receivable within the magnet holder 212. In the illustrated embodiment, the magnet holder 212 includes legs 216 extending from the inner surface 208 of the cover 40. The legs 216 define a slot 220 in which the magnet 200 is received. In other words, the magnet holder 212 is configured to receive the magnet 200 within the slot 220. In other embodiments, the magnet holder 212 may be positioned on the inner surface 116 of the front plate 34. Furthermore, the magnet holder 212 may extend into the cavity 204 adjacent the lockout member 166 of the dry-fire lockout mechanism 150. The magnet 200 is positioned adjacent the lockout member 166 within the magnet holder 212 when the cover 40 is coupled to the front plate 34. Furthermore, the magnet 200 is positioned offset from the second pivot axis 110. The magnet 200 is configured to exert a magnetic biasing force on the ferromagnetic material of the lockout member 166, as further discussed below.

With reference to FIGS. 6 and 8, the inner surface 116 of the front plate 34 further defines first and second apertures 224, 228. The first and second apertures 224, 228 are positioned on the inner surface 116 between the first and second mounting flanges 154, 158. The first aperture 224 is configured to receive the pin 56 of the pusher 50, as further discussed below. The second aperture 228 is configured to receive the protrusion 164 of the base 162.

With continued reference to FIG. 8, the front plate 34 further defines a notch 232 positioned on the side of the nosepiece assembly 30 having the workpiece contact element 46 (i.e. the first side 26 of the magazine body 18). The third segment 76 of the workpiece contact element 46 extends from the second segment 74 through the notch 232 (FIG. 1). Furthermore, the cover 40 encloses the notch 232 when coupled to the front plate 34 (FIG. 1).

With reference to FIG. 9, the first end 190 of the lockout member 166 further includes a lip 240. The first end 62 of the pin 56 of the pusher 50 is configured to engage the lip 240 when a predetermined number (e.g., 0, 1, 2, etc.) of fasteners remain in the magazine 14. Specifically, the second end 66 of the pin 56 extends through the first aperture 224 in the front plate 34 when the predetermined number of fasteners remain in the magazine 14 (FIG. 11B). In some embodiments, the predetermined number of fasteners may be zero. In other embodiments, the predetermined number of fasteners may be 1, 2, 3, etc. The second end 194 of the lockout member 166 is positioned adjacent the second edge 98 of the fourth segment 78 of the workpiece contact element 46. In addition, the recess 94 defined in the workpiece contact element 46 is configured to receive the second end 194 of the lockout member 166, as further discussed below.

With reference to FIG. 10, a top surface 244 of the pusher bracket 54 is facing towards the front plate 34. A channel 248 (FIG. 8) is formed between the lower guide 52 coupled to the pusher bracket 54 and a bottom surface 252 of the front plate 34 (FIG. 6). The channel 248 is configured to receive the fasteners when driving into the workpiece.

Figure 11A:
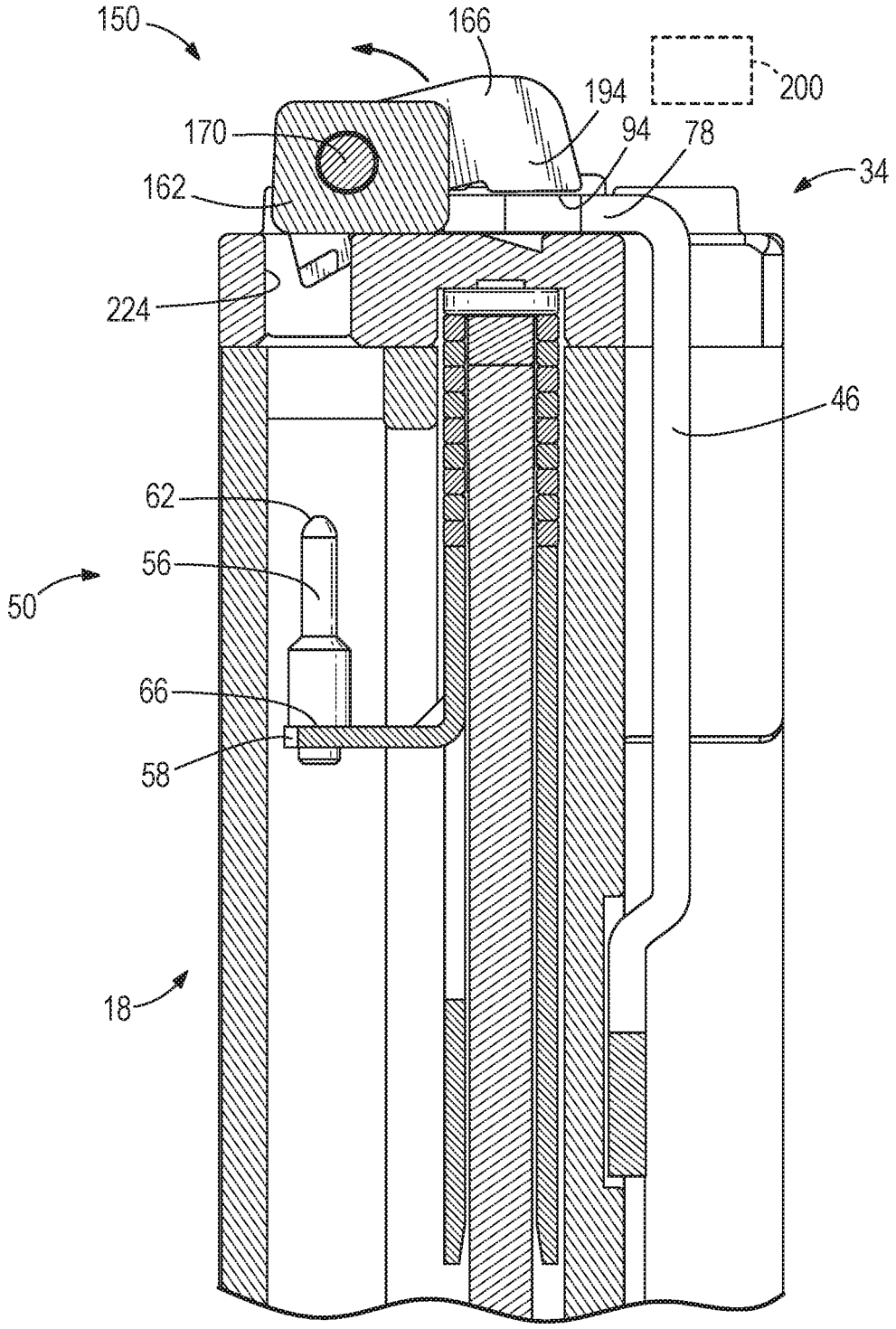
FIG. 11A is a cross-sectional view of the nosepiece assembly of the fastener driver taken along lines 11A-11A of FIG. 2, illustrating a first position of the dry-fire lockout mechanism.
Figure 11B:
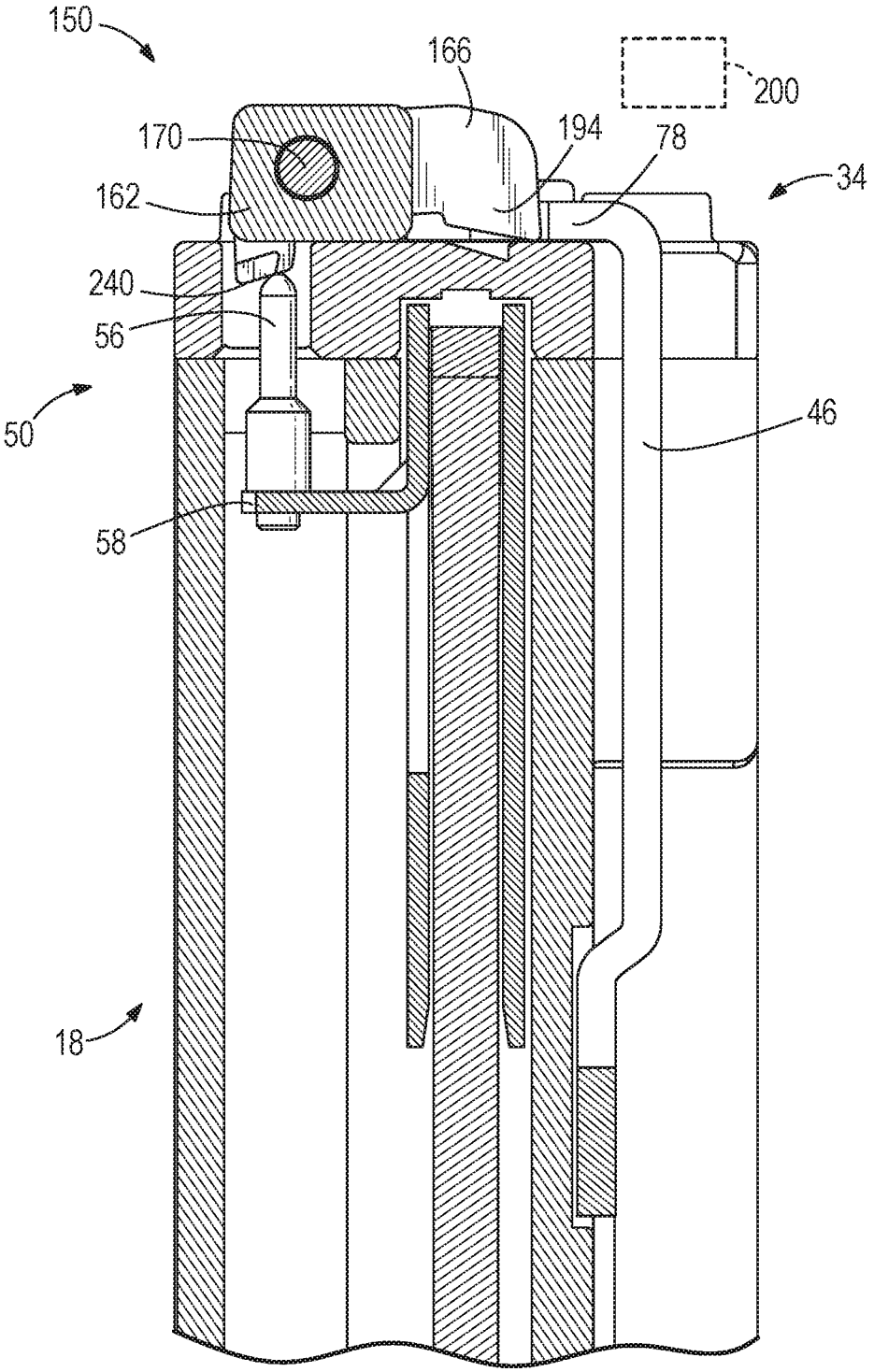
FIG. 11B is a cross-sectional view of the nosepiece assembly of the fastener driver similar to FIG. 11A, illustrating a second position of the dry-fire lockout mechanism.

With reference to FIG. 11A, the lockout member 166 is magnetically biased to a first position (i.e., a non-blocking position) by the magnet 200 when fasteners remain in the magazine 14. Specifically, when in the first position, the second end 194 of the lockout member 166 extends toward (i.e., is oriented towards, in a facing relationship with) the magnet 200. Furthermore, with the lockout member 166 in the first position, the workpiece contact element 46 (i.e. the fourth segment 78) is able to slide past the lockout member 166, allowing for actuation of the powered fastener driver.

With reference to 11B, the lockout member 166 is moved (i.e. pivoted) to a second, blocking position by the pusher 50 engaging the lockout member 166. The magnet 200, received in the magnet holder 212, is positioned adjacent the lockout member 166 within the cavity 204. Specifically, the pusher 50 is configured to move the lockout member 166 toward the second position against the magnetic bias of the magnet 200 when the predetermined number of fasteners remain in the magazine 14. As such, the second end 194 of the lockout member 166 is positioned farther from the magnet 200 when in the second position than when the lockout member 166 is in the first position (FIG. 11B). In particular, the lockout member 166 is substantially perpendicular to the longitudinal axis 100 of the fourth segment 78 of the workpiece contact element 46. The second end 194 of the lockout member 166 is received within the recess 94 when the lockout member 166 is in the blocking position. More specifically, the lockout member 166 is received within the recess 94 when the workpiece contact element 46 is displaced to abut the lockout member 166.

With continued reference to FIGS. 11A and 11B, the lockout member 166 pivots about the second axis 110, allowing the lockout member 166 to pivot between the first position (FIG. 11A) and the second position (FIG. 11B). The first end 190 of the lockout member 166 is engaged by the pin 56 of the pusher 50 in the second position. The second end 194 of the lockout member 166 is configured to block the movement of the workpiece contact element 46 in the second position. In some embodiments, the movement of the workpiece contact element 46 along the axis 100 is stopped completely by the second end 194 of the lockout member 166.

In operation, when fasteners remain in the magazine 14, the pusher 50 biases the fasteners toward the first flange 36 of the front plate 34 of the nosepiece assembly 30 where they are driven into a workpiece by actuation of the fastener driver. With fasteners in the magazine 14, the lockout member 166 is biased toward the first position (FIG. 11A) by the magnet 200, which allows for the workpiece contact element 46 to slide with respect to the front plate 34 of the nose piece assembly 30 to enable actuation of the fastener driver.

When the predetermined number of fasteners remain in the magazine 14, the pin 56 of the pusher 50 extends through the first aperture 224 in the front plate 34 and engages the first end 190 of the lockout member 166. The pusher 50 pivots the lockout member 166 about the axis 110 from the first position (FIG. 11A) to the second position (FIG. 11B). In other words, the pusher 50 overcomes the magnetic force exerted by the magnet 200 on the second end 194 of the lockout member 166 to pivot the lockout member 166 to the second position when the predetermined number of fasteners remain in the magazine 14. When the lockout member 166 is in the second position, movement of the workpiece contact element 46 is blocked in order to prevent further activation of the powered fastener driver. In some embodiments, the lockout member 166 pivots to the second position when no fasteners remain in the magazine 14 (i.e., the predetermined number is zero). In other embodiments, the lockout member 166 pivots to the second position when a small number of fasteners (e.g., 1, 2, 3, etc.) remain in the magazine (i.e., the predetermined number is 1, 2, 3, etc.).

As such, the lockout member 166 of the dry-fire lockout mechanism 150 is operable to pivot from the first position to the second position when the predetermined number of fasteners remain in the magazine 14. With the lockout member 166 blocking the movement of the workpiece contact element 46, dry-firing of the powered fastener driver is prevented.

Various features and advantages of the invention are set forth in the following claims.

What is claimed is:

1. A powered fastener driver comprising:

a magazine configured to receive fasteners;

a pusher slidably coupled to the magazine;

a nosepiece coupled to the magazine, the nosepiece having a first side and a second side opposite the first side, the first side of the nosepiece at least partially defining a fastener driving channel through which consecutive fasteners from the magazine are driven;

a workpiece contact element movable with respect to the nosepiece;

a lockout member pivotally coupled to the nosepiece;

a magnet exerting a magnetic force on the lockout member to bias the lockout member toward a first position; and a cover coupled to the second side of the nosepiece, the cover defining a cavity and a magnet holder configured to receive the magnet;

wherein the lockout member is at least partially received in the cavity; and wherein the pusher moves the lockout member to a second position where the lockout member blocks movement of the workpiece contact element when a predetermined number of fasteners remain in the magazine.

2. The powered fastener driver of claim 1, wherein the predetermined number of fasteners is zero.

3. The powered fastener driver of claim 1, wherein the magnet holder includes legs extending from an inner surface of the cover, and wherein the legs define a slot in which the magnet is received.

4. The powered fastener driver of claim 1, wherein at least a portion of the lockout member is formed of a ferromagnetic material.

5. The powered fastener driver of claim 1, wherein the lockout member further includes an insert formed of a ferromagnetic material.

6. The powered fastener driver of claim 1, wherein the pusher includes a pin that engages the lockout member when the predetermined number of fasteners remain in the magazine.

7. The powered fastener driver of claim 6, wherein the lockout member includes a first end and a second end opposite the first end, and wherein the pin engages the first end when the predetermined number of fasteners remain in the magazine and the second end blocks the movement of the workpiece contact element when the lockout member is in the second position.

8. The powered fastener driver of claim 1, wherein the workpiece contact element translates with respect to the nosepiece along a first axis, and the lockout member pivots about a second axis parallel to the first axis.

9. The powered fastener driver of claim 1, wherein the lockout member pivots about a rotational axis, and wherein the magnet is positioned offset from the rotational axis.

10. The powered fastener driver of claim 1, wherein the lockout member defines a pivot axis, and wherein the lockout member pivots about the axis between the first position and the second position.

11. The powered fastener driver of claim 1, wherein the workpiece contact element is configured to slide past the lockout member when the lockout member is in the first position.

12. The powered fastener driver of claim 1, wherein an end of the lockout member is positioned farther from the magnet when the lockout member is in the second position than when the lockout member is in the first position.

13. The powered fastener driver of claim 1, wherein the workpiece contact element defines a recess, and wherein an end of the lockout member is receivable in the recess when the lockout member is in the second position.

14. The powered fastener driver of claim 1, wherein the pusher moves the lockout member to overcome a magnetic force exerted by the magnet on the lockout member when the predetermined number of fasteners remain in the magazine.

15. A powered fastener driver comprising:

a magazine configured to receive fasteners;

a pusher slidably coupled to the magazine, the pusher including a pin;

a nosepiece coupled to the magazine, the nosepiece having a first side and a second side opposite the first side, the first side of the nosepiece at least partially defining a fastener driving channel through which consecutive fasteners from the magazine are driven;

a workpiece contact element movable with respect to the nosepiece;

a lockout member pivotally coupled to the nosepiece, the lockout member including a first end engageable with the pin, a second end opposite the first end, and at least a portion formed of a ferromagnetic material;

a cover coupled to the second side of the nosepiece, the cover defining a magnet holder; and a magnet coupled to the cover by the magnet holder;

wherein a portion of the workpiece contact element is positioned between the second side of the nosepiece and the cover;

wherein at least one of the lockout member and the portion of the workpiece contact element is at least partially enclosed by the cover;

wherein the magnet exerts a magnetic force on the lockout member to bias the lockout member toward a first position;

wherein the pin engages the first end of the lockout member when a predetermined number of fasteners remain in the magazine;

wherein the pin pivots the lockout member to a second position where the second end of the lockout member blocks movement of the workpiece contact element when the predetermined number of fasteners remain in the magazine; and wherein the predetermined number of fasteners is zero.

16. The powered fastener driver of claim 15, wherein the magnet holder includes legs extending from an inner surface of the cover, and wherein the legs define a slot in which the magnet is received.

17. The powered fastener driver of claim 15, wherein the lockout member further includes an insert formed of a ferromagnetic material.

18. The powered fastener driver of claim 15, wherein the lockout member defines a pivot axis, and wherein the lockout member pivots about the axis between the first position and the second position.

19. The powered fastener driver of claim 15, wherein the workpiece contact element is configured to slide past the lockout member in the first position.

* * * * *